US005699997A

United States Patent [19]

Huang

[11] Patent Number: 5,699,997

[45] Date of Patent: Dec. 23, 1997

[54] FOLDABLE PLAYYARD CONNECTION DEVICE

[76] Inventor: Li-chu Chen Huang, No. 99, Fuchou 7th St., Chiayi City, Taiwan

[21] Appl. No.: 636,014

[22] Filed: Apr. 22, 1996

[51] Int. Cl.[6] ..... E04H 17/16

[52] U.S. Cl. ..... 256/26; 256/45; 256/66; 256/60; 5/99.1; 403/94; 16/343; 16/349

[58] Field of Search ..... 403/102, 72, 79, 403/92, 94; 5/99.1, 93.1; 256/25, 26, 45, 60, 66; 16/333, 343, 347, 349

[56] References Cited

U.S. PATENT DOCUMENTS

| | | | |
|---|---|---|---|
| 50,566 | 10/1865 | Dummer | 16/343 |
| 87,243 | 2/1869 | Cathcart | 16/343 |
| 1,618,885 | 2/1927 | Minor | 16/333 X |
| 3,046,595 | 7/1962 | Johansson et al. | 16/343 |
| 4,226,549 | 10/1980 | Batt | 403/92 |
| 4,566,150 | 1/1986 | Boothe | 16/349 X |
| 4,619,542 | 10/1986 | Kassai | 403/102 X |
| 4,780,929 | 11/1988 | Burns et al. | 16/349 |
| 5,211,498 | 5/1993 | Huang | 16/347 X |
| 5,239,714 | 8/1993 | Huang | 5/99.1 |
| 5,243,718 | 9/1993 | Shamie | 5/99.1 |
| 5,279,006 | 1/1994 | Teng | 5/99.1 |
| 5,358,220 | 10/1994 | Yu-Kuang | 256/25 |
| 5,446,931 | 9/1995 | Wei | 5/99.1 |
| 5,457,828 | 10/1995 | Huang | 16/347 X |
| 5,504,951 | 4/1996 | Yeh | 5/93.1 X |

*Primary Examiner*—Kenneth J. Dorner
*Assistant Examiner*—Bruce A. Lev
*Attorney, Agent, or Firm*—Testa, Hurwitz & Thibeault, LLP

[57] ABSTRACT

A connection device for a playyard consists of a handle and two connectors. The handle is provided integrally with a block and a plurality of protrusions having a hole therein. A pair of connectors is each provided with a plurality of spaces for receiving supports and a projecting portion having a pin stably secured therein or pivotally connected with the protrusion. When the handle is connected with the connectors by a fastener, and a holding portion is in horizontal position, the connectors are not able to be folded because of the restriction of the block within two stops of the connectors, and when the holding portion is in vertical position, two connectors are able to be folded together.

9 Claims, 6 Drawing Sheets

FOLDABLE PLAYYARD CONNECTION DEVICE

FIELD OF THE INVENTION

The present invention generally relates to a connection-device for a playyard, and more particularly to a device having a safe and stable structure, which combines with an upper frame and a lower frame to achieve a better connection with an improvement of a connection device.

BACKGROUND OF THE INVENTION

Various attempts have been made to provide a foldable playyard, from which a baby's bed may be adapted to use the same to provide a safer space for an occupant to stay, especially an infant. Typical foldable structures are disclosed in U.S. Pat. No. 4,934,025 and U.S. Pat. No. 4,985,948 both by John V. Mariol. G 94 14 045.6 also disclosed a foldable structure with an improved frame assembly. Particularly, the TW. Pat. No. 83,202,736 disclosed a foldable playyard combining an upper support, a lower support and four vertical rail sections wherein, two safety switch units and fastener units are used to provide connection between a corner bracket with another. Though this type of foldable playyard has a reduced volume after being folded, yet several drawbacks still exist. When a user tries to fold the assembly, he/she will have to try very hard to press down the fastener unit before turning all the rail sections. Furthermore, due to the large volume of the playyard, the lower part of the playyard is merely supported by two posts, which is not adequate to prevent shaking and/or moving when the playyard is in use. Thus, the present invention aims to provide an improved connection device for a foldable playyard to mitigate and/or obviate the aforementioned problems.

SUMMARY OF THE INVENTION

The main objective of the invention is to provide a connection device and in particular to a connection device for a foldable playyard. The connection device has a switch unit centrally coupled with a pair of rail sections of the upper support to achieve readily a simple folding.

Another objective of the invention is to provide a connection device for a foldable playyard composed of a plurality of longitudinal supports and lateral supports. A switch unit functioning as both a switch and a connector is provided between two longitudinal supports or two lateral supports. Connecting supports have a switch unit configured to have an inner positioning seat having a recess provided therein and an outer positioning seat connecting therebetween for easy folding. To fold a playyard, a button having a projection corresponding to the recess provided within the inner positioning seat is simply pressed and then the switch unit is lifted upward. Owing to the recess within the inner positioning seat and the projection of the button, the invention therefore provides a safer and stable structure for a foldable playyard.

Still another objective of the invention is to provide a handle in the lower structure of the foldable playyard of one preferable embodiment. The lower structure of the foldable playyard presents a firm foundation by the connection of the handle with protrusions configured onto corresponding side of a positioning seat which is to connect one frame with another, when the handle is in a horizontal position.

It is yet another objective of the invention to provide a handle made of a material having hardness and durability to reduce the risk of wear and fracture after long term use.

Other objects, advantages and novel features of the invention will become more apparent from the following detailed description when taken in conjunction with the accompanying drawings.

BRIEF DESCRIPTION OF THE DRAWINGS

The present invention will now be better understood with the reference to the accompanying drawings wherein.

DETAILED DESCRIPTION OF THE PREFERRED EMBODIMENT

Figure 1:
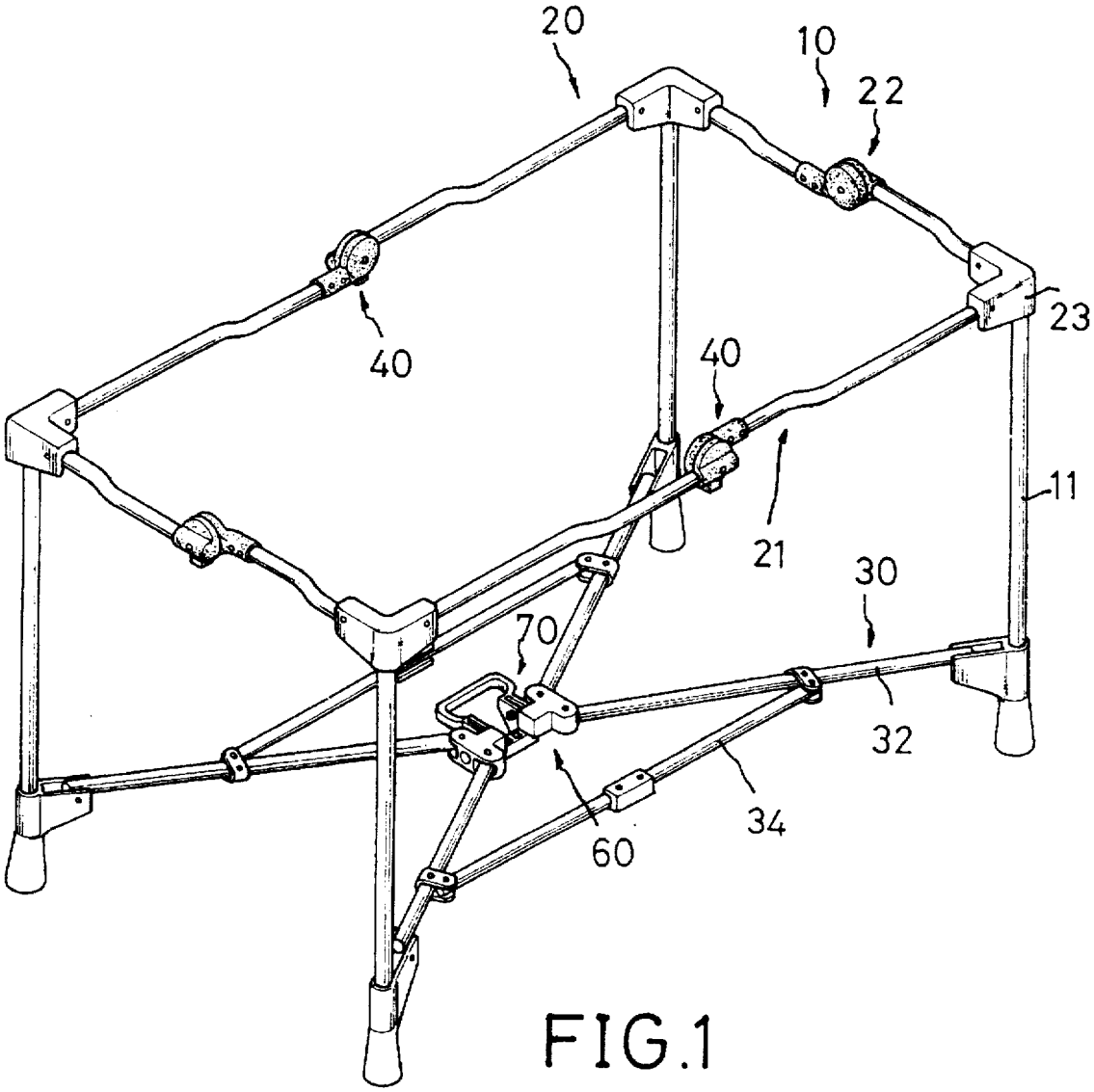
FIG. 1 is a perspective view of a connection device used in a foldable playyard.

Referring first to the drawings and particularly FIG. 1, wherein a connection device constructed in accordance with the present invention has a preferred application, especially when being used in a foldable playyard.

A foldable playyard comprises an upper supporting portion 10 and a lower supporting portion 30 with a plurality of rods 11 connecting and extending therebetween. The upper supporting portion 10 comprises a plurality of lateral supports 22 and longitudinal supports 21, and every two of the lateral and longitudinal supports 22, 21 have a switch unit 40 connected therebetween to permit folding thereof. A coupler 23 is used to couple respective ends of a corresponding lateral support 22, a corresponding longitudinal support 21 and a corresponding rod 11. The disclosure of the switch unit 40 has already been filed to the German Patent Office with an application number: 195 44 615.1, thus there will be no detailed description about the switch unit 40.

Figure 2:
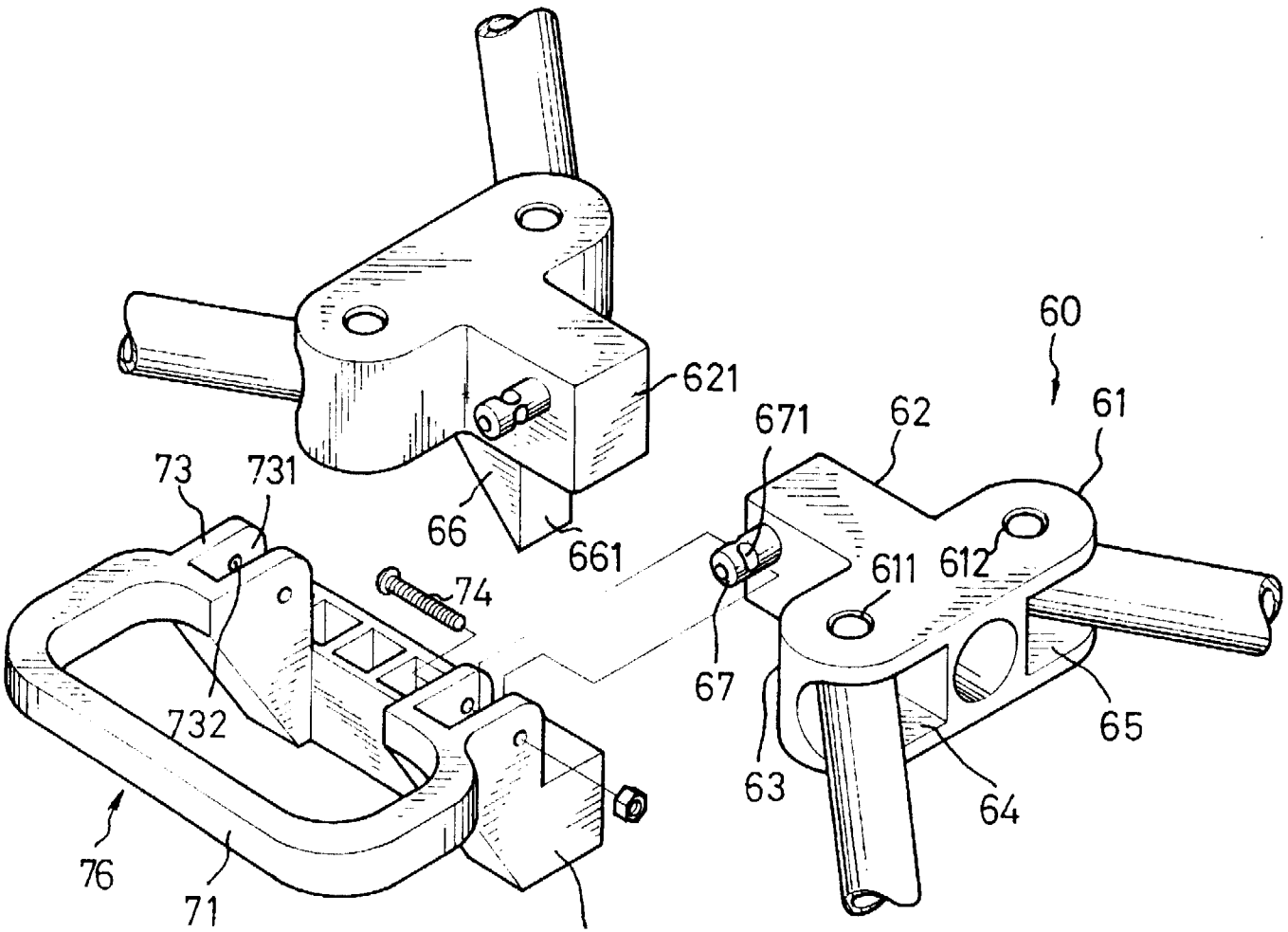
FIG. 2 is an exploded view of the connection device constructed in accordance with the present invention.

Referring now to FIG. 1 and FIG. 2, the lower supporting portion 30 comprises a plurality of diagonal bars 32, and a pair of braces 34. Connection between the rods 11, diagonal bars 32, and braces 34 is well known in the art, thus there will be no detailed description about the connecting structure therebetween. As shown in FIG. 2, the connection device comprises a symmetrically opposed pair of T-shaped connectors 60 and a handle 70. Each connector 60 includes a long portion 61 and a short portion 62 integrally and perpendicularly extending from a midpoint of a first side 63 of the long portion 61. A pair of recesses 64 is respectively defined in opposite ends of the long portion 61 in a second side 65 opposite to the first side 63. A pair of first through-holes 611, each extends through a respective end of the long portion 61 from a top face to a bottom face thereof and in communication with the recesses 64 and therein. A stop 66 extends integrally downward from the bottom face of the long portion 61 of each connector 60 and has a front surface 661 parallel to a front surface 621 of the short portion 62 such that a space is defined between the symmetrically opposed stops 66 when the handle 70 is pivotally secured therebetween, as will be described later. A pin 67 pivotally and perpendicularly extends from one side face of the short portion 62. Each pin 67 has a second through-hole 671 with an axis parallel to the side face of the short portion 62. The recess 64 and 65, each pivotally receives one end of a respective diagonal bar 32 by means of a pin (not labeled) which pivotally secures the diagonal bar 32 therein via the first through-hole 611.

Figure 3:
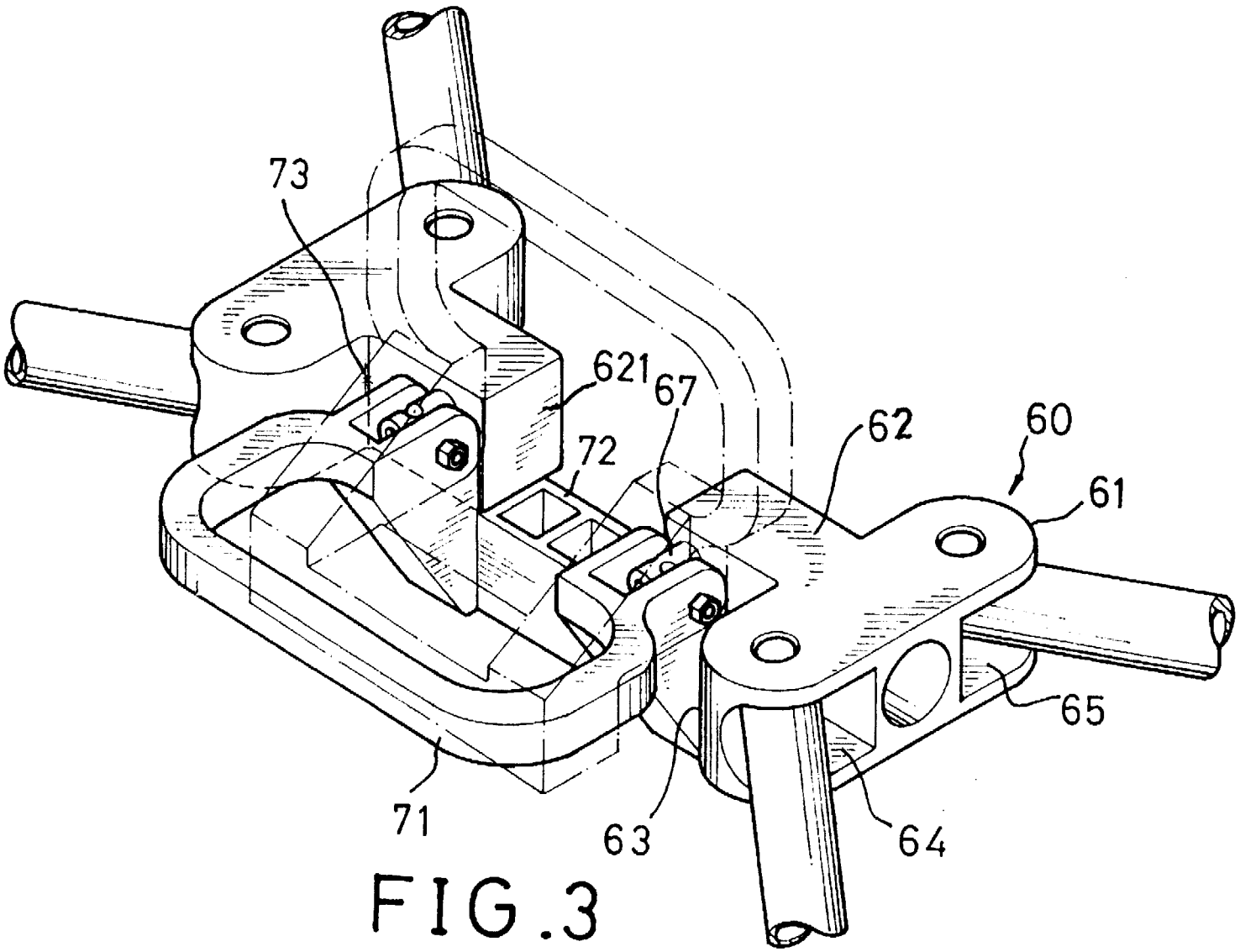
FIG. 3 is a perspective view of the connection device assembled together.
Figure 4:
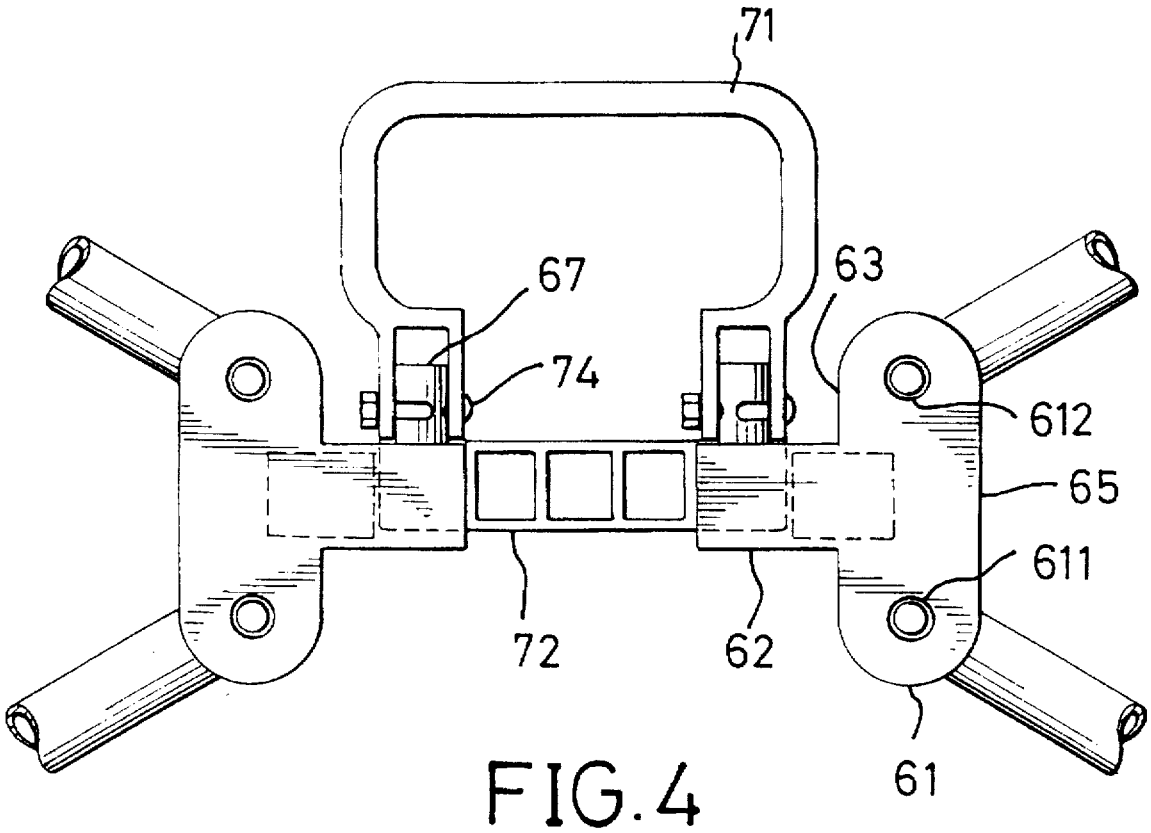
FIG. 4 is a top end view of the invention with a handle in a horizontal position.
Figure 5:
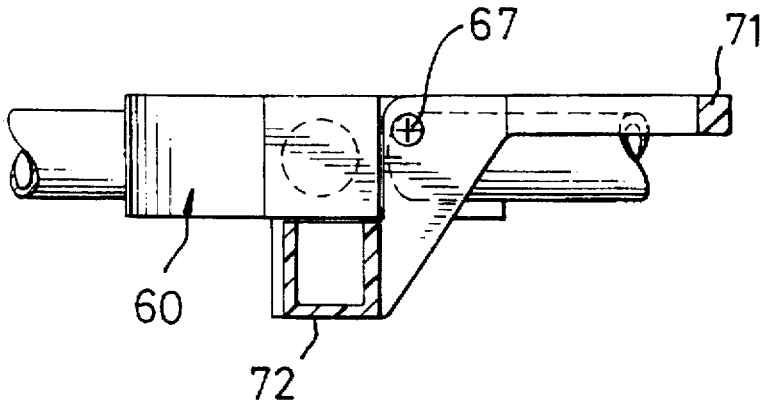
FIG. 5 is a side view of the connection device showing the handle disposed in a horizontal position.
Figure 6:
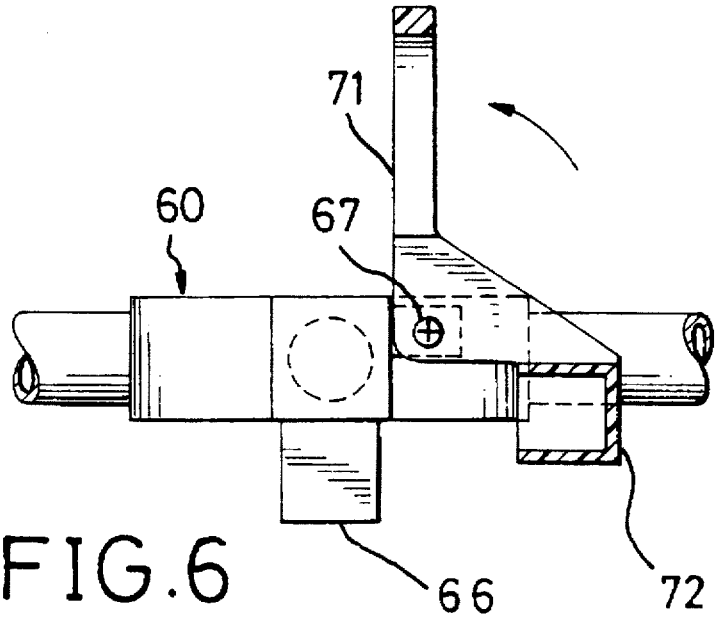
FIG. 6 is also a side view of the connection device showing the handle disposed in a vertical position.
Figure 7:
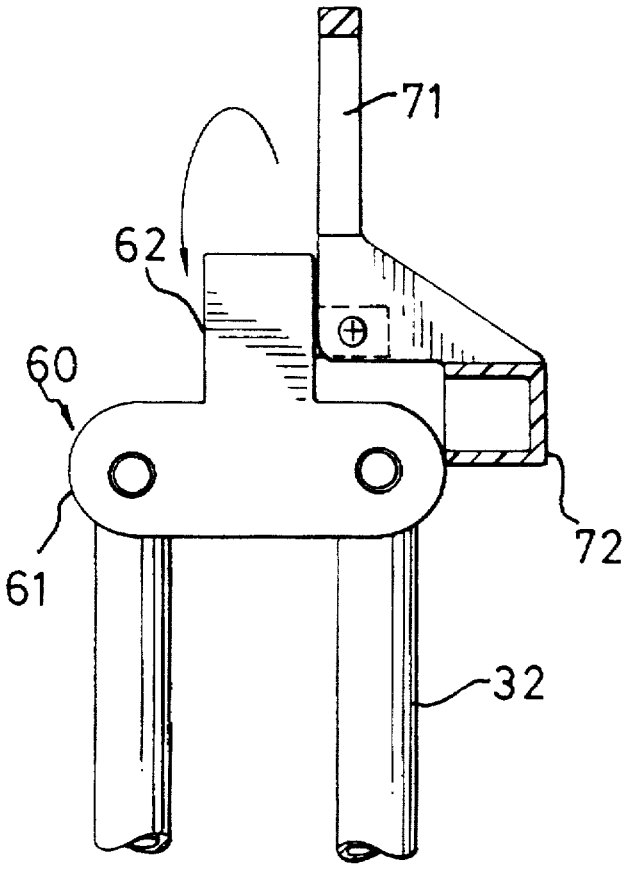
FIG. 7 is another top end view of the connection device while two supports connected to the opposite side of the device are fully folded.

The handle 70 integrally includes a grip portion 71, a bar portion 72 and two pairs of U-shaped connecting portions 73 extending therebetween. Each pair of connecting portions 73 comprises two arms extending in a direction of, yet above, the bar portion 72 and has an opening 731 provided therebetween. Each pair of connecting portions 73 is sized and configured to receive the corresponding pin 67 within the opening 731. A pair of third through-holes 732 is transversely defined in each connecting portion 73 and communicates with the opening 731 therebetween, such that when a respective pin 67 is received in the opening 731 of each connecting portion 73, a bolt 74 is extended through the third through-holes 732 and the second through-hole 671 in a conventional manner to threadedly engage with a nut such that the handle 70 is pivotally linked to the two connectors 60. As shown in FIGS. 3, 4, and 5, when the handle 70 is in a horizontal position, the bar portion 72 fits snugly in the space defined by the two stops 66, whereby the connectors 60 and the diagonal bars 32 are supported in a horizontally extended position. However, when the handle 70 is swung upward, as shown by the phantom lines in FIG. 3, and the solid line of FIG. 6, the bar portion 72 leaves the space defined by the two stops 66 and since the two stops 66 are thus not restricted by the bar portion 72, the connectors 60 are able to be folded toward each other as a result of the second through-holes 671 each having a countersink at both ends thereof. As shown in FIG. 7, when the handle 70 is swung upward, the two stops 66 of the connectors 60 are not limited by the bar portion 72, such that the diagonal bars 32 will be able to be folded together along with the folding movement of the connectors 60.

Figure 8:
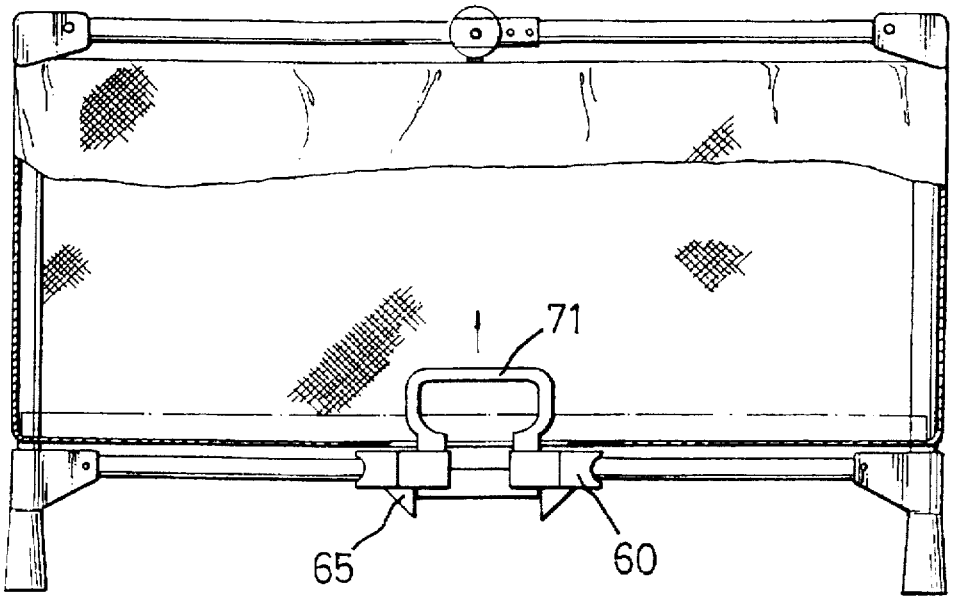
FIG. 8 is another embodiment of the connection device constructed in accordance with the present invention showing the handle of the device is lifted in a vertical direction.
Figure 9:
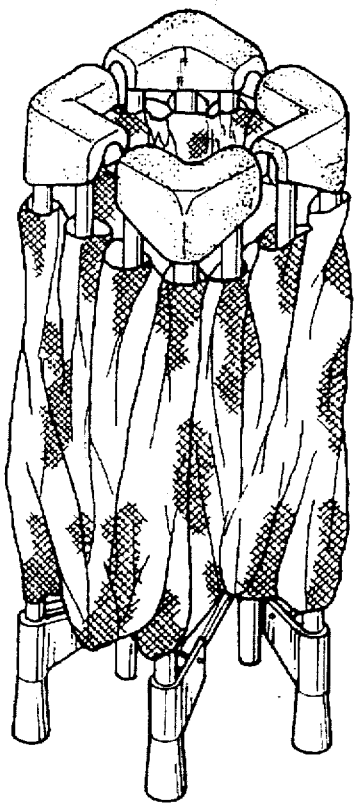
FIG. 9 is still another embodiment of FIG. 8, which shows a playyard is being folded together after the connection device of FIG. 8 is being lifted upward.

Referring to the preferred embodiment of the invention of FIG. 8 and 9, where a connection device is used in bottom of a playyard, when a person is trying to fold a playyard, he simply needs to swing the grip portion 71 of the handle 70 upwardly to release the restriction of the block 75 oo the stop 65 of the connector 60, and because the space between the two stops 65 is not filled by the block 75 after the handle 70 has been awung upwardly, the whole playyard is folded together as shown in FIG. 9.

From the foregoing, it is seen that the objects hereinbefore set forth may readily and efficiently be attained, and since certain changes may be made in the above construction and different embodiments of the invention without departing from the scope thereof, it is intended that all matter contained in the above description or shown in the accompanying drawings shall be interpreted as illustrative and not in a limiting sense.

What is claimed is:

1. A connection device comprising:

a symmetrically opposed pair of connectors having a long portion with a plurality of recesses defined therein and having a top face, a bottom face, a first side and a second side;

a short portion integrally and perpendicularly extending from said first side of said long portion and having a front surface;

a plurality of first through-holes each extending through a respective end of said long portion from said top face to said bottom face thereof and in communication with said recesses therein;

a handle having a grip portion with two ends, a bar portion and a plurality of pairs of connecting portions extending therebetween;

stop means extending from said long portion; and retaining means extending from said short portion, said retaining means comprising a pin extending pivotally and perpendicularly from a side face of said short portion;

wherein said connection device is adapted to pivotally receive a plurality of diagonal bars each within one of said recesses via one of said first through-holes; and wherein said pairs of said connecting portions are U-shaped with two arms each extending in a direction to said bar portion and defining an opening therebetween.

2. The connection device as claimed in claim 1, wherein said pin defines a second through-hole having an axis parallel to said side face of said short portion.

3. The connection device as claimed in claim 1, wherein said two arms comprises third through-holes therein.

4. The connection device as claimed in claim 3, wherein said pin is pivotally received within said opening between said two arms by means of said second through-hole and said third through-holes with a fastener.

5. The connection device as claimed in claim 1, wherein said retaining means is integrally formed on said side face of said short portion.

6. The connection device as claimed in claim 1, wherein said bar portion fits snugly between said front faces of said stops.

7. The connection device as claimed in claim 1, wherein said connectors are T-shaped.

8. The connection device as claimed in claim 1, wherein said short portion extends from a mid-point of said first side of said long portion.

9. The connection device as claimed in claim 1, wherein said stop means is a block extending integrally and downwardly from said bottom face of each of said connectors.

* * * * *